US009777498B1

(12) United States Patent
Farrier et al.

(10) Patent No.: US 9,777,498 B1
(45) Date of Patent: Oct. 3, 2017

(54) FLUSH MOUNTED VINYL NOZZLE ASSEMBLY AND METHODS OF USE

(71) Applicant: GSG Holdings, Inc., Chandler, AZ (US)

(72) Inventors: M. Shaun Farrier, Peoria, AZ (US); Steve Sharp, Phoenix, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 183 days.

(21) Appl. No.: 14/495,162

(22) Filed: Sep. 24, 2014

Related U.S. Application Data

(60) Provisional application No. 61/883,889, filed on Sep. 27, 2013.

(51) Int. Cl.
*E04H 4/16* (2006.01)

(52) U.S. Cl.
CPC ..... *E04H 4/169* (2013.01)

(58) Field of Classification Search
CPC .. E04H 4/169; E04H 4/14; E04H 4/16; E04H 4/1209; B05B 1/00
USPC ..... 4/492, 490, 507, 541.6
See application file for complete search history.

(56) References Cited

U.S. PATENT DOCUMENTS

| | | | | |
|---|---|---|---|---|
| 3,749,424 | A * | 7/1973 | Greene | F16L 47/28 285/139.1 |
| 5,195,191 | A * | 3/1993 | Stefan | E04H 4/1272 4/496 |
| 5,408,706 | A * | 4/1995 | Barnes | E03F 5/0407 210/163 |
| 9,267,303 | B1 * | 2/2016 | Goettl | E04H 4/169 |
| 2008/0148500 | A1 * | 6/2008 | Ribeiro | E04H 4/169 15/1.7 |

* cited by examiner

*Primary Examiner* — J. Casimer Jacyna
(74) *Attorney, Agent, or Firm* — Booth Udall Fuller, PLC

(57) ABSTRACT

A pool nozzle assembly having a body, a clamp ring, a plurality of screws, a cover ring, and a nozzle is disclosed. The body includes a body rim having a plurality of screw receivers and a female threaded portion. The clamp ring is removably coupled to the body and couples a vinyl liner between the clamp ring and the body. The clamp ring includes an inner rim and an outer rim. The plurality of screws removably couple the clamp ring to the body. The cover ring includes a cover rim and a male threaded portion threadedly coupled to the female threaded portion. The cover rim covers the plurality of screws and is substantially planar with the outer rim. The nozzle is removably coupled to the base of the body such that a top end of the nozzle is substantially planar with outer rim and the cover rim.

10 Claims, 3 Drawing Sheets

FLUSH MOUNTED VINYL NOZZLE ASSEMBLY AND METHODS OF USE

CROSS REFERENCE TO RELATED APPLICATIONS

This document claims the benefit of the filing date of U.S. Provisional Patent Application 61/883,889, entitled "Flush Mounted Vinyl Nozzle Body and Assembly" to Sharp which was filed on Sep. 27, 2014, the contents of which are hereby incorporated by reference.

BACKGROUND

1. Technical Field

Aspects of this document relate generally to pool nozzle assemblies.

2. Background Art

Nozzle assemblies are often used in pools and spas to mount a nozzle to the surface a pool. Particular nozzle assemblies are designed for pools with a vinyl liner on the pool surface. Conventional nozzle assemblies require one or more screws to hold down a clamp ring, which then squeezes the liner between two gaskets and a flange on the nozzle body to create a watertight assembly. The screws of these assemblies, however, are visible and are considered by some to be unsightly. Furthermore, the clamp ring is approximately ⅜" above the pool surface, a height that is objectionable to some pool owners. Conventional pool nozzle assemblies also require users to cut a hole in the vinyl liner before anything secures the vinyl liner. This is problematic because it can lead to the vinyl liner slipping out of the nozzle assembly. Conventional pool nozzle assemblies are also configured in a way that a user may inadvertently unscrew the whole assembly when merely trying to remove cleaning nozzle.

SUMMARY

According to one aspect, a pool nozzle assembly may comprise a body comprising a base configured to couple to a water line coupling, a body rim comprising a plurality of screw receivers, and a first coupling portion between the body rim and the base, a clamp ring removably coupled to the body and configured to couple a vinyl liner between the clamp ring and the body, the clamp ring comprising a recessed inner rim, a plurality of screw holes extending through the recessed inner rim and aligned with the plurality of screw receivers of the body, and an outer rim, a plurality of screws extending through the plurality of screw holes into the plurality of screw receivers to removably couple the clamp ring to the body, a cover ring comprising a second coupling portion and a cover rim, wherein the second coupling portion is directly and mechanically engaged with the first coupling portion of the body, and the cover rim covers the plurality of screws and is substantially planar with the outer rim of the clamp ring, and a nozzle removably coupled to the base of the body such that a top end of the nozzle is substantially planar with outer rim and the cover rim.

Particular embodiments of the disclosure may comprise one or more of the following. The first coupling portion of the body may comprise a female threaded portion and the second coupling portion of the cover ring comprises a male threaded portion threadedly engaged with the female threaded portion of the body. The body may further comprise an outer ring extending from the body rim away from the female threaded portion and configured to hold the vinyl liner between the outer ring and the outer rim of the clamp ring. The base may further comprise one or more keys and the clamp ring comprises one or more key slots aligned with and interfacing the one or more keys. The base of the body may further comprise one or more bayonets that engage with one or bayonets on the nozzle to removably couple the nozzle to the body.

According to another aspect of the disclosure, a pool nozzle assembly may comprise a body comprising a first coupling portion, a clamp ring removably and adjustably coupled to the body and configured to couple a vinyl liner between the clamp ring and the body, the clamp ring comprising a recessed inner rim removably coupled to the body below an outer plane of the body and an outer rim positioned above the outer plane of the body, and a cover ring comprising a second coupling portion and a cover rim, wherein the second coupling portion is directly and mechanically engaged with the first coupling portion to removably and adjustably couple the cover ring to the body and the cover rim covers the inner rim and is substantially planar with the outer rim of the clamp ring.

Particular embodiments of the disclosure may comprise one or more of the following. The first coupling portion may comprise a female threaded portion and the second coupling portion comprises a male threaded portion threadedly coupled to the female threaded portion. The body may further comprise a body rim comprising a plurality of screw receivers, the inner rim comprises a plurality of screw holes aligned with the plurality of screw receivers, and the clamp ring is removably and adjustably coupled to the body with a plurality of screws extending through the screw holes and into the screw receivers. The body may further comprise a plurality of keys and the clamp ring comprises a plurality of key slots engaged with the plurality of keys. The body may further comprise a base having a plurality of bayonets. The body may further comprise an outer ring proximate the body rim such that the body rim is between the outer ring and the first coupling portion, and wherein the clamp ring is adjustably coupled to the body to hold the vinyl liner between the outer rim and the outer ring, and between the inner rim and the body rim.

According to yet another aspect of the disclosure, a method of mounting a pool nozzle assembly to a pool having a vinyl liner may comprise coupling a body to a water line such that an outer ring of the body is substantially flush with a pool base, adjustably coupling a recessed inner rim of a clamp ring to a body rim of the body until a vinyl liner is held between the inner rim and the body rim and between an outer rim of the clamp ring and the inner ring of the body, adjustably coupling a cover ring to the body by directly and mechanically engaging a first coupling portion of the body with a second coupling portion of the cover ring until a cover rim of the cover ring is substantially planar with the outer rim of the clamp ring and covers the inner rim of the clamp ring, inserting a nozzle through the cover ring and the clamp ring and into the body until a top end of the nozzle is substantially planar with the cover rim and the outer rim, and coupling the nozzle to a base of the body.

Particular embodiments of the disclosure may comprise one or more of the following. Adjustably coupling an inner rim of a clamp ring to a body rim of the body may comprise adjustably coupling the inner rim of the clamp ring to the body rim of the body with a plurality of screws inserted through a plurality of screw holes on the inner rim of the clamp ring and into a plurality of screw receivers on the body rim. Adjustably coupling a cover ring to the body by directly and mechanically engaging a first coupling portion of the body with a second coupling portion of the body may comprise threadedly coupling a female threaded portion of the body with a male threaded portion of the cover ring. Coupling the nozzle to the base of the body may comprise coupling the nozzle to the base of the body by engaging bayonets on the base of the body with bayonets on the nozzle. Aligning the clamp ring with the body by inserting one or more keys on the body into one or more key slots on the clamp ring.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended pool nozzle assembly and/or assembly procedures for a pool nozzle assembly will become apparent for use with implementations of pool nozzle assemblies from this disclosure. Accordingly, for example, although particular cleaning nozzles, screws, bodies, clamp rings, and cover rings are disclosed, such cleaning nozzles, screws, and the like and implementing components may comprise any shape, size, style, type, model, version, measurement, concentration, material, quantity, and/or the like as is known in the art for such cleaning nozzles, screws, bodies, clamp rings, and cover rings and implementing components, consistent with the intended operation of pool nozzle assembly.

Embodiments of a flush mounted vinyl pool nozzle assembly contemplated herein are advantageous to conventional pool nozzle assemblies known in the art for various reasons which will become evident upon review of this disclosure. For example, according to some aspects, a nozzle assembly may include a cleaning nozzle having a top end that is substantially planar with a clamp ring and a cover ring. The clamp ring and cover ring are substantially flush with the vinyl liner of a pool, having only an insignificant and nearly unobservable raise above the vinyl liner of the pool (see FIG. 2). This results in a nozzle assembly that is less likely to cause harm to a pool user and/or less likely to be damaged by a pool user because the nozzle assembly does not extend significantly above the vinyl liner of the pool.

One or more embodiments of a flush mounted vinyl pool nozzle assembly contemplated as part of this disclosure are also advantageous to conventional pool nozzle assemblies because an installer may secure or anchor the vinyl liner to the body of the nozzle assembly prior to cutting the vinyl liner in anticipation of insertion of the cleaning nozzle. Because an installer is able to anchor the vinyl liner to the nozzle assembly before cutting the vinyl liner in anticipation of inserting the cleaning nozzle through the vinyl liner, the vinyl liner is unlikely to slip out from the nozzle assembly.

One or more embodiments of a flush mounted vinyl pool nozzle assembly contemplated as part of this disclosure are also advantageous to conventional pool nozzle assemblies because removal of a cleaning nozzle is unlikely to unscrew or rotate the hole nozzle assembly. For example, in some non-limiting embodiments, the cleaning nozzle is couple to a body with bayonets. By rotating the cleaning nozzle to disengage the bayonets, the body and clamp ring are unaffected by removal and replacement of the cleaning nozzle.

Figure 1:
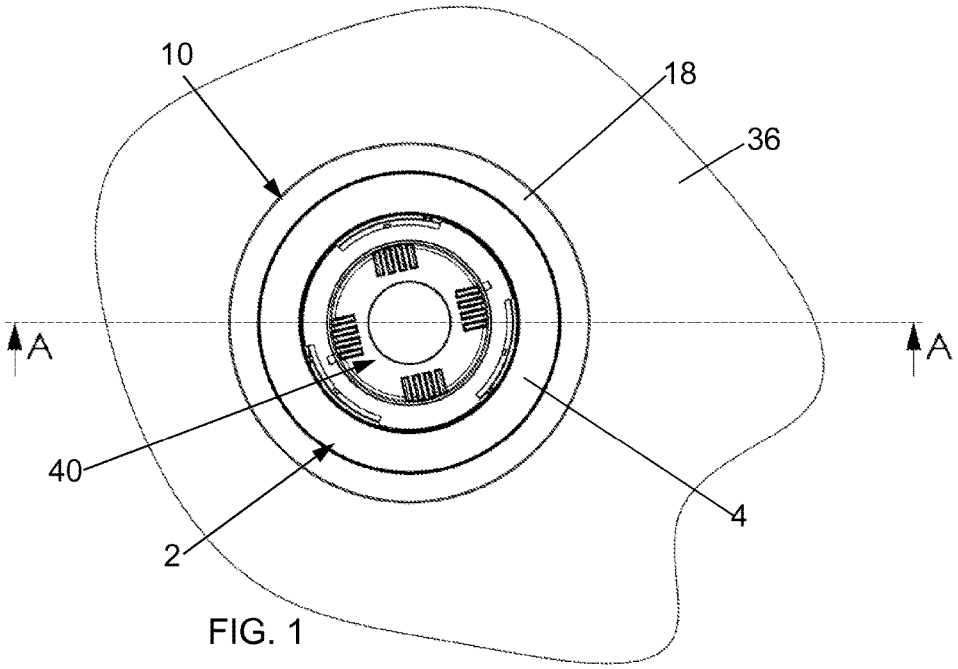
FIG. 1 is a top view of a pool nozzle assembly mounted in a vinyl lined pool.

FIG. 1 depicts a top view of a non-limiting embodiment of a pool nozzle assembly mounted to a pool having a vinyl liner 36. According to some aspects, a pool nozzle assembly comprises a cleaning nozzle 40, a cover ring 2, a clamp ring 10, and a body 20 (not visible in FIG. 1). When installed into the pool, typically only a top end 46 of the cleaning nozzle, a cover rim 4 of the cover ring 2, and an outer rim 18 of the clamp ring 10 are visible. Each of the top end 46 of the cleaning nozzle, the cover rim 4, and the outer rim 18 are typically substantially planar with one another. More particularly, each of the top end 46 of the cleaning nozzle, the cover rim 4, and the outer rim 18 are typically only raised above the vinyl liner 36 in an insignificant amount, as depicted in FIGS. 2 and 3.

Figure 2:
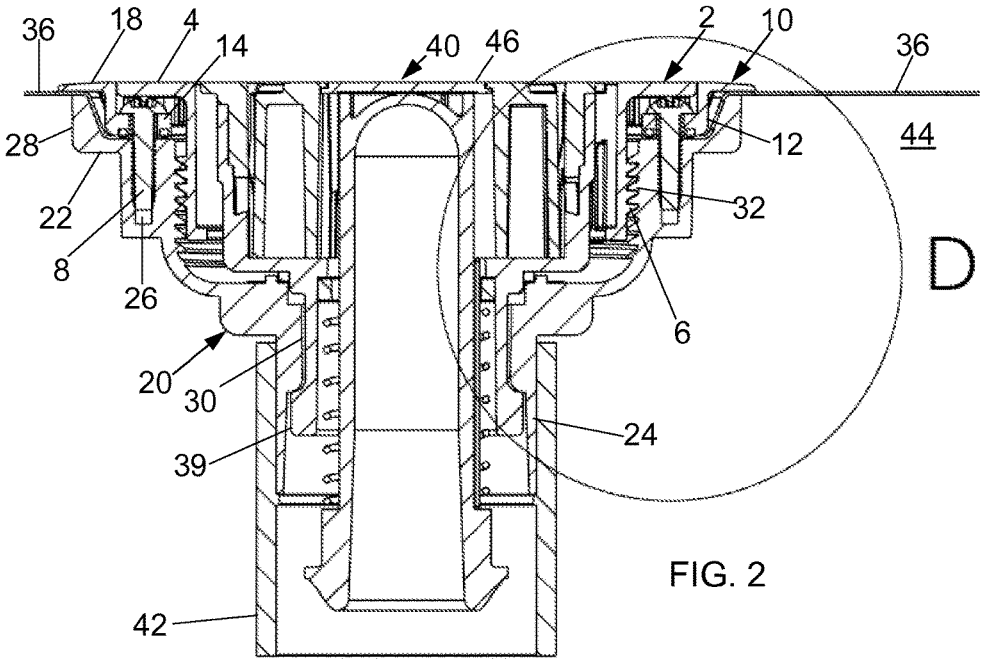
FIG. 2 is a cross-sectional view of a pool nozzle assembly mounted in a vinyl lined pool taken along line A-A of FIG. 1.
Figure 3:
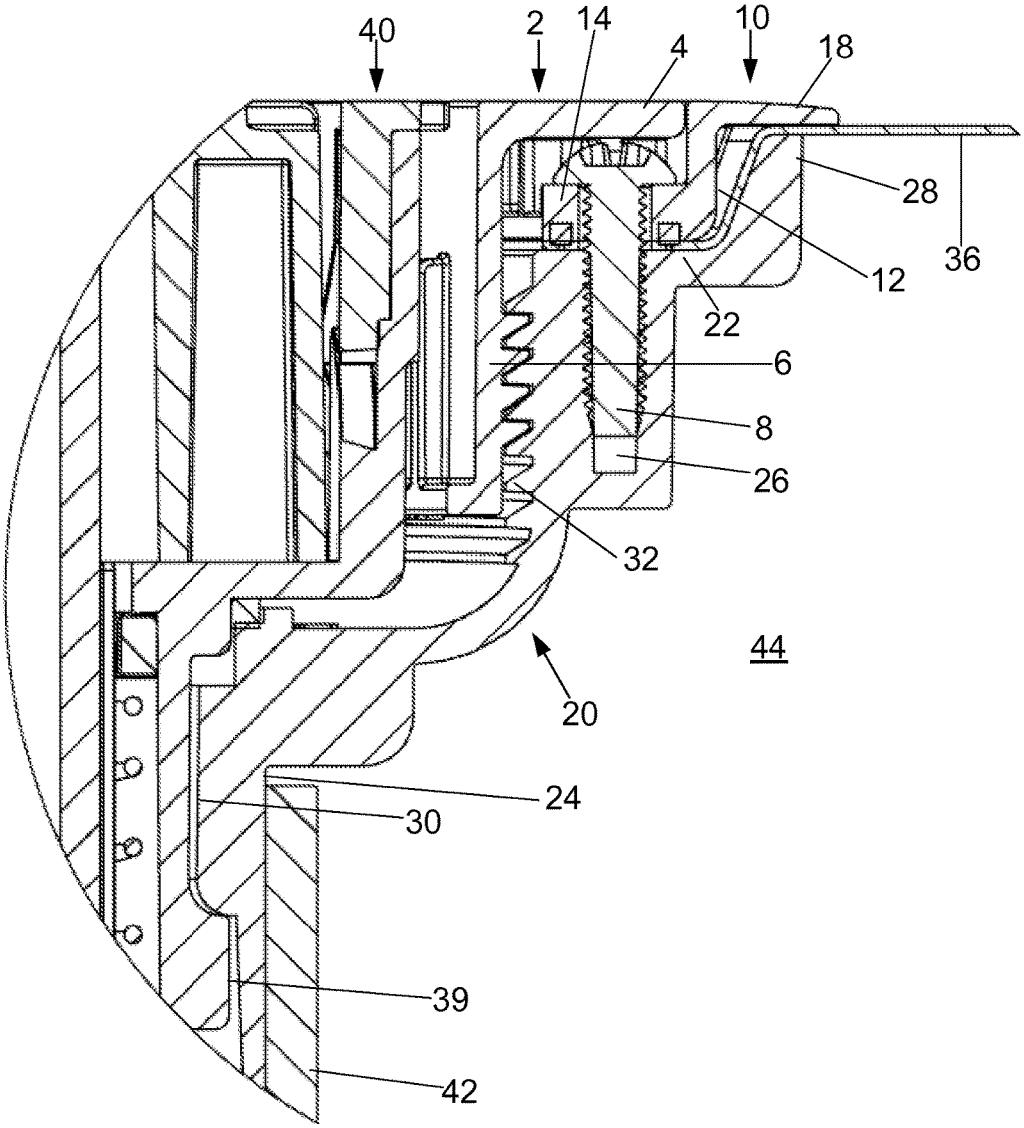
FIG. 3 is an enlarged view of the area encompassed by circle D in FIG. 2.

FIG. 2 depicts a cross-sectional view of a non-limiting embodiment of a pool nozzle assembly taken along line A-A of FIG. 1. According to some aspects of a nozzle assembly, a body 20 of the nozzle assembly is coupled to a water line with a line coupling 42. The line coupling 42 may comprise any coupling known in the art to couple a nozzle assembly to a water line. More particularly, the body 20 may comprise a base 24 configured to slide within the line coupling 42 to couple to the line coupling 42.

Figure 4:
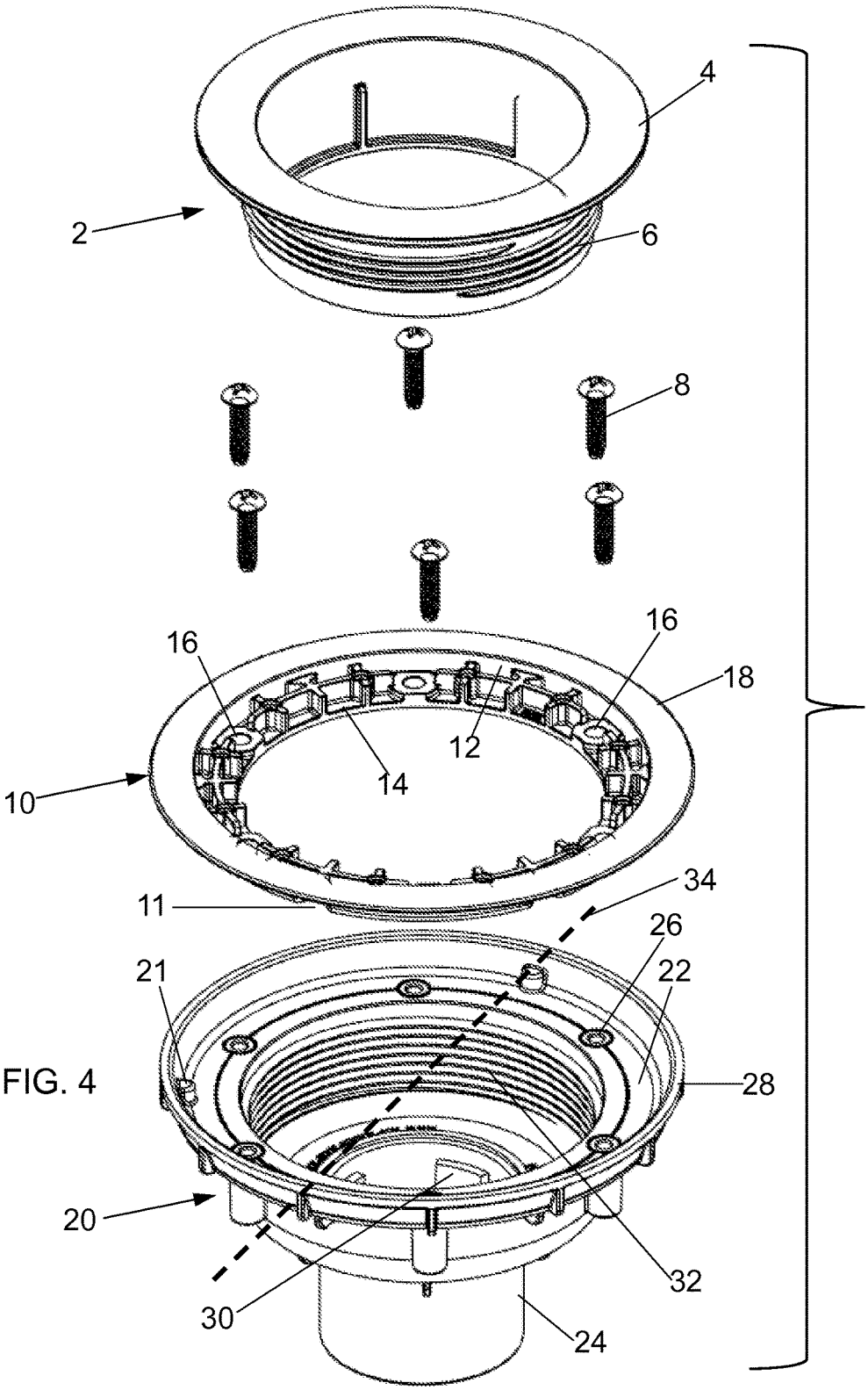
FIG. 4 is an exploded view of a pool nozzle assembly.

One or more embodiments of a body 20 of a nozzle assembly further comprise a body rim 22. The body rim 22 is typically recessed or below an outer plane 34 of the body 20 and configured to removably couple to a clamp ring 10. The outer plane 34 of the body 20 is typically formed by an outer ring 28 of the nozzle assembly. FIGS. 2 and 3 depict non-limiting embodiments of a clamp ring 10 removably coupled to the body 20 at the body rim 22, and FIG. 4 depicts an exploded view of a non-limiting embodiment of a nozzle assembly that provides a perspective view of a body rim 22. As depicted in FIGS. 2 and 3, the body rim 22 is typically recessed sufficiently that the recessed inner rim 14 of the clamp ring 10 is positioned below the outer plane 34 and at least a portion of the outer ring 28 of the body 20.

Embodiments of the body 22 are typically configured to removably couple to clamp ring 10 with any removable coupling mechanism known in the art, such as but not limited to screws, threaded coupling, pins, and the like. In the non-limiting embodiment depicted in FIGS. 2-4, the body rim comprises a plurality of screw receivers 26 each configured to receive a screw 8 to adjustably and removably couple the clamp ring 10 to the body 20. In one or more embodiments, a body 20 further comprises at least one key 21 corresponding to a key slot 11 on the clamp ring 10 to allow a user to properly align the clamp ring 10 with the body 20 before coupling the clamp ring 10 to the body 20. The key 21 typically comprises a protrusion shaped complementary to the key slot 11. In other embodiments, the key 21 may be positioned on the clamp ring 10 and the key slot 11 positioned on the body 20.

One or more embodiments of a body 20 of a nozzle assembly further comprise a first coupling portion. The first coupling may be positioned between the body rim 22 and the base 24 and is configured to mechanically and directly couple the body 20 to the cover 2. The first coupling portion may comprise any coupling known in the art configured to mechanically and directly couple the body 20 to the cover 2, such as but not limited to threaded coupling, screws, and the like. In the non-limiting embodiment depicted in FIGS. 2-4, the first coupling portion comprises a female threaded portion 32 configured to threadedly couple to a male threaded portion 6 on the cover ring 2 to mechanically and directly couple the cover ring 2 to the body 20. The female threaded portion 32, or any other coupling utilized, is positioned to allow a user to coupled the cover ring 2 such that a cover rim 4 of the cover ring 2 is substantially planar with the outer rim 18 of the clamp ring 10.

One or more embodiments of a body 20 of a nozzle assembly further comprise one or more bayonets 30 on an inner surface of the base 24. The bayonets 30 of the body 20 are spaced and sized to allow insertion of a portion of the nozzle 40 into the base 24. The bayonets 30 of the body 20 are further spaced and sized to engage with bayonets 39 on the nozzle 40 upon rotation of the nozzle to removably couple the nozzle 40 to the body 20. FIGS. 3 and 4 depict non-limiting embodiments of bayonets 30 of the body 20 engaged with bayonets 39 of the nozzle 40 to removably couple the nozzle 40 to the body 20. FIG. 4 depicts a perspective view of a portion of two bayonets 30 on an inner surface of the base 24.

Various embodiments of a pool nozzle assembly contemplated in this disclosure further comprise a clamp ring 10 removably and adjustably coupled to the body 20. According to some aspects, the clamp ring 10 holds or pinches the vinyl liner 36 between the clamp ring 10 and the body 20. Because the clamp ring 10 is adjustably coupled to the body 20, the nozzle assembly may be utilized with varying thicknesses of vinyl liners 26. As used herein, adjustably coupled refers to the ability of a user to adjust the distance between the clamp ring 10 and the body 20 to adjust for different thicknesses of vinyl liners 36.

The exploded view of a non-limiting embodiment of a nozzle assembly in FIG. 4 provides a perspective view of a clamp ring 10. According to some aspects, a clamp ring 10 comprises an outer rim 18 and a recessed inner rim 14. Typically, a sidewall 12 is positioned between the outer rim 18 and the recessed inner rim 14. A clamp ring 10 may also comprise a plurality of ribs on the recessed inner rim 14 and one or more key slots 11 corresponding to the one or more keys 21 of the body 20.

As noted above, the clamp ring 10 is configured to removably adjustably couple to the body 20. According to some aspects, such as the non-limiting embodiment depicted in FIGS. 2-4, the clamp ring 10 removably couples to the body 20 with a plurality of screws 8 the extend through a plurality of screw holes 16 on the inner rim of the clamp ring 10 and into the screw receivers 26 on the body rim 22 of the body 20. By tightening or loosening the screws 8, a user may adjust the coupling of the clamp ring 10 to the body 20 to the particular thickness of the vinyl liner 36. In other embodiments, the clamp ring 10 may be removably and adjustably coupled to the body 20 through any mechanism known in the art, such as but not limited to threaded coupling and/or pins.

FIGS. 2 and 3 depicts a cross-sectional view of a clamp ring 10 holding a vinyl liner 36 between the clamp ring 10 and the body 20. According to some aspects, the vinyl liner is held or pinched between the body rim 22 and the recessed inner rim 14 and/or between the outer ring 28 and the outer rim 18 when the clamp ring 10 is coupled to the body 20. The screws 8 also extend through the screw holes 16 of the clamp ring 10, the vinyl liner 36, and into the screw receivers 26. When properly coupled together, the recessed inner rim 14 is typically positioned within the body 20 below the outer plane 34 and at least partially below the outer ring 28. The head of each screw 8 is typically positioned below the plane of the outer rim 18 of the clamp ring 10 to allow for proper coupling of the cover ring 2 to the body 20.

One or more embodiments of a nozzle assembly further comprises a cover ring 2. The cover ring 2 is configured to cover the screws 8 and the recessed inner rim 14 of the clamp ring 10. This inhibits undesired and accidental loosening of the clamp ring 10, as well as prevents the hazard of exposed screws and uneven plastic on the bottom surface of a pool. According to some aspects, the cover ring 2 comprises a second coupling portion and a cover rim 4. The second coupling portion may comprise any coupling known in the art configured to mechanically engage and directly couple to the first coupling portion of the body 20. In the non-limiting embodiment of FIGS. 2-4, the second coupling portion comprises a male threaded portion 6 that mechanically and directly engages with the female threaded portion 32 of the body 20 to removably and adjustably couple the cover ring 2 to the body 20. Typically, the user may threadedly couple the cover ring 2 to the body 20 until the cover rim 4 is substantially planar with the outer rim 18 of the clamp ring 10 (shown in FIGS. 2 and 3).

Also contemplated as part of this disclosure is a method of mounting a pool nozzle assembly to a pool having a vinyl liner 36. According to some aspects, the method comprises coupling a body 20 to a water inlet such that an outer ring 28 and an outer plane 34 of the body 20 is substantially flush with a pool base 44. A method may further comprise aligning a clamp ring 10 with the body 20 by inserting one or more keys 21 on the body 20 into one or more key slots 11 on the clamp ring 10. A method may further comprise adjustably coupling a recessed inner rim 14 of a clamp ring 10 to a body rim 22 of the body 20 until a vinyl liner 36 is held between the inner rim 14 and the body rim 22 and between an outer rim 18 of the clamp ring 10 and the inner ring 28 of the body 20. Adjustably coupling an inner rim 14 of a clamp ring 10 to a body rim 22 of the body 20 may comprise adjustably coupling the inner rim 14 of the clamp ring 10 to the body rim 22 of the body 20 with a plurality of screws 8 inserted through a plurality of screw holes 16 on the inner rim 14 of the clamp ring 10 and into a plurality of screw receivers 26 on the body rim 22. According to some aspect, the vinyl layer 36 is cut from the center of the clamp ring 10 before the cover ring 2 is installed.

A method may further comprise adjustably coupling a cover ring 2 to the body 20 by directly and mechanically engaging a first coupling portion of the body 20 with a second coupling portion of the cover ring 2 until a cover rim 4 of the cover ring 2 is substantially planar with the outer rim 18 of the clamp ring 10 and covers the inner rim 14 of the clamp ring 10. Adjustably coupling a cover ring 2 to the body 20 by directly and mechanically engaging a first coupling portion of the body 20 with a second coupling portion of the body 20 may comprise threadedly coupling a female threaded portion 32 of the body 20 with a male threaded portion 6 of the cover ring 2.

The method may further comprise inserting a nozzle 40 through the cover ring 4, the vinyl liner 36, and the clamp ring 10 and into the body 20 until a top end 46 of the nozzle is substantially planar with the cover rim 4 and the outer rim

18. Alternatively, the nozzle 40 may be inserted into the nozzle assembly prior to coupling of the cover ring 2 to the body 20, and in particular implementations it may be done before installation of vinyl liner 36. The method may further comprise coupling the nozzle to a base of the body. Coupling the nozzle 40 to the body 20 may comprise coupling the nozzle 40 to a base 24 of the body 20 by engaging bayonets 30 on the base 24 of the body 20 with bayonets 39 on the nozzle 40.

It will be understood that implementations are not limited to the specific components disclosed herein, as virtually any components consistent with the intended operation of a method and/or system implementation for pool nozzle assemblies may be utilized. Accordingly, for example, although particular cleaning nozzles, screws, bodies, clamp rings, and cover rings may be disclosed, such components may comprise any shape, size, style, type, model, version, class, grade, measurement, concentration, material, weight, quantity, and/or the like consistent with the intended operation of a method and/or system implementation for a pool nozzle assembly may be used.

In places where the description above refers to particular implementations of pool nozzle assemblies, it should be readily apparent that a number of modifications may be made without departing from the spirit thereof and that these implementations may be applied to other pool nozzle assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A pool nozzle assembly, comprising:

a body comprising a base configured to couple to a water line coupling, a body rim comprising a plurality of screw receivers, and a first coupling portion between the body rim and the base;

a clamp ring removably coupled to the body and configured to couple a vinyl liner between the clamp ring and the body, the clamp ring comprising a recessed inner rim, a plurality of screw holes extending through the recessed inner rim and aligned with the plurality of screw receivers of the body, and an outer rim;

a plurality of screws extending through the plurality of screw holes into the plurality of screw receivers to removably couple the clamp ring to the body;

a cover ring comprising a second coupling portion and a cover rim, wherein the second coupling portion is directly and mechanically engaged with the first coupling portion of the body, and the cover rim covers the plurality of screws and is substantially planar with the outer rim of the clamp ring; and a nozzle removably coupled to the base of the body such that a top end of the nozzle is substantially planar with outer rim and the cover rim.

2. The pool nozzle assembly of claim 1, wherein the first coupling portion of the body comprises a female threaded portion and the second coupling portion of the cover ring comprises a male threaded portion threadedly engaged with the female threaded portion of the body.

3. The pool nozzle assembly of claim 2, wherein the body further comprises an outer ring extending from the body rim away from the female threaded portion and configured to hold the vinyl liner between the outer ring and the outer rim of the clamp ring.

4. The pool nozzle assembly of claim 3, wherein the base further comprises one or more keys and the clamp ring comprises one or more key slots aligned with and interfacing the one or more keys.

5. The pool nozzle assembly of claim 4, wherein the base of the body further comprises one or more bayonets that engage with one or bayonets on the nozzle to removably couple the nozzle to the body.

6. A mounting assembly for a pool nozzle, comprising:

a body comprising a first coupling portion;

a clamp ring removably and adjustably coupled to the body and configured to couple a vinyl liner between the clamp ring and the body, the clamp ring comprising a recessed inner rim removably coupled to the body below an outer plane of the body and an outer rim positioned above the outer plane of the body; and a cover ring comprising a second coupling portion and a cover rim, wherein the second coupling portion is directly and mechanically engaged with the first coupling portion to removably and adjustably couple the cover ring to the body and the cover rim covers the inner rim and is substantially planar with the outer rim of the clamp ring;

wherein the body further comprises a base having a plurality of bayonets.

7. The mounting assembly of claim 6, wherein the first coupling portion comprises a female threaded portion and the second coupling portion comprises a male threaded portion threadedly coupled to the female threaded portion.

8. The mounting assembly of claim 6, wherein the body further comprises a body rim comprising a plurality of screw receivers, the inner rim comprises a plurality of screw holes aligned with the plurality of screw receivers, and the clamp ring is removably and adjustably coupled to the body with a plurality of screws extending through the screw holes and into the screw receivers.

9. The mounting assembly of claim 8, wherein the body further comprises a plurality of keys and the clamp ring comprises a plurality of key slots engaged with the plurality of keys.

10. The mounting assembly of claim 6, wherein the body further comprises an outer ring proximate a body rim between the outer ring and the first coupling portion, and wherein the clamp ring is adjustably coupled to the body to hold the vinyl liner between the outer rim and the outer ring, and between the inner rim and the body rim.

* * * * *